US007468492B2

(12) United States Patent
Lai

(10) Patent No.: US 7,468,492 B2
(45) Date of Patent: Dec. 23, 2008

(54) ELECTRICAL SWITCH

(75) Inventor: Chi Leung Lai, Hong Kong (CN)

(73) Assignee: Defond Components Limited, Chaiwan, Hong Kong (CN)

( * ) Notice: Subject to any disclaimer, the term of this patent is extended or adjusted under 35 U.S.C. 154(b) by 0 days.

(21) Appl. No.: 11/849,448

(22) Filed: Sep. 4, 2007

(65) Prior Publication Data

US 2008/0053804 A1 Mar. 6, 2008

Related U.S. Application Data

(60) Provisional application No. 60/824,474, filed on Sep. 5, 2006.

(51) Int. Cl.
*H01H 9/28* (2006.01)

(52) U.S. Cl. ..... 200/43.16; 200/43.11

(58) Field of Classification Search ..... 200/43.01, 200/43.11, 43.16, 43.18, 43.19, 43.21, 553, 200/566, 318, 318.1, 318.2, 321, 322, 323, 200/324, 325, 339, 334
See application file for complete search history.

(56) References Cited

U.S. PATENT DOCUMENTS 3,678,229 A * 7/1972 Osika ..... 200/43.01
4,013,858 A 3/1977 Grebner et al.
4,480,159 A * 10/1984 Kirchoff ..... 200/43.16
4,870,230 A * 9/1989 Osika et al. ..... 200/6 R
4,942,272 A * 7/1990 Sorenson ..... 200/43.16
4,947,009 A * 8/1990 Osika et al. ..... 200/43.16
4,994,636 A 2/1991 Wang
5,045,648 A * 9/1991 Fogleman, Sr. ..... 200/43.16
5,095,181 A * 3/1992 Osika et al. ..... 200/43.16
5,998,743 A * 12/1999 Unkel ..... 200/43.11
6,084,186 A * 7/2000 Shaffer ..... 200/43.16
6,759,609 B1 * 7/2004 Henderson et al. ..... 200/43.11
6,812,419 B2 * 11/2004 Fukui et al. ..... 200/332.2
6,989,503 B2 * 1/2006 Wong ..... 200/522
2001/0004044 A1 6/2001 Sotome et al.

FOREIGN PATENT DOCUMENTS

DE 44 22 475 A 1/1996
EP 0 812 044 A 12/1997

* cited by examiner

*Primary Examiner*—Michael A Friedhofer
(74) *Attorney, Agent, or Firm*—Leydig, Voit & Mayer, Ltd.

(57) ABSTRACT

An electrical switch has at least two fixed contacts and a moving contact lever movable between an ON position making contact with one of the fixed contacts and an OFF position breaking contact with one of the fixed contacts. A rocker pivots in opposite directions between a first position, moving the contact lever into the ON position and a second position, moving the contact lever into the OFF position. A locking member associated with the rocker automatically locks the rocker in each of the first and second positions. The locking member is releasable to unlock the rocker upon manual movement of the locking member in a direction different from directions of movement of the rocker.

20 Claims, 5 Drawing Sheets

100
150
140
123B
153
120
131
132
133

151
141
123B

123A

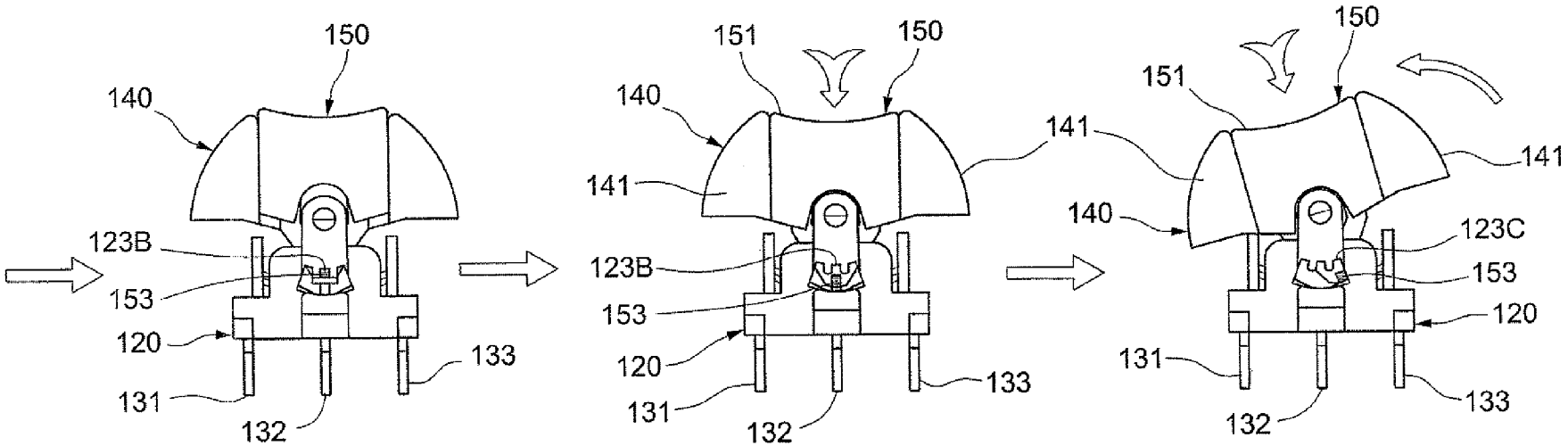
FIG.3F
FIG.3G
FIG.3H
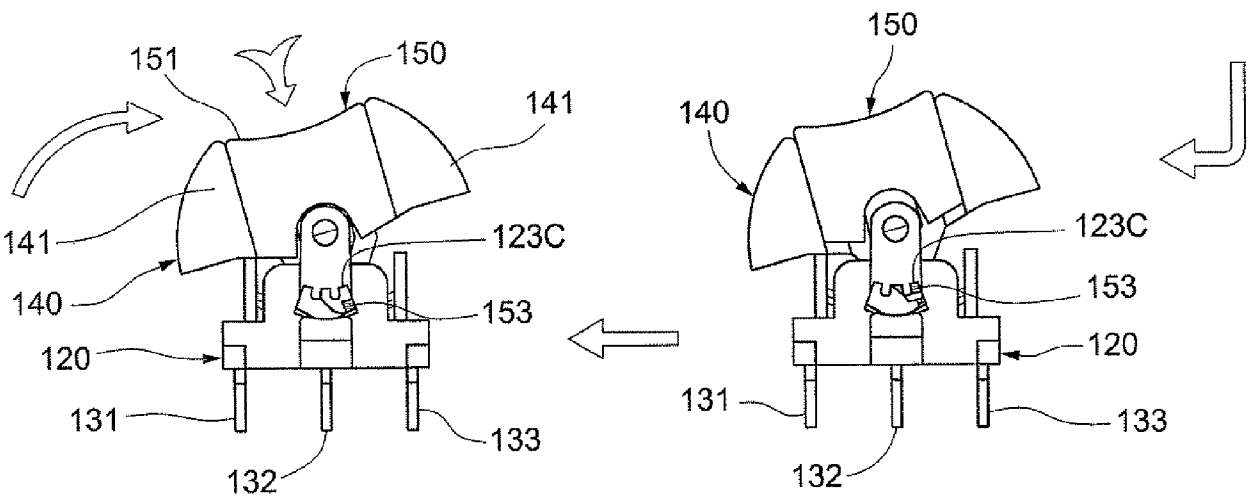
FIG.3I
FIG.3J

ELECTRICAL SWITCH

The present invention relates to an electrical switch which can be locked in both of its switched ON and OFF positions.

SUMMARY OF THE INVENTION

According to the invention, there is provided an electrical switch comprising a casing, at least two fixed contacts, and a moving contact supported in the casing for movement between an ON position making contact with at least a first fixed contact of said at least two fixed contacts and an OFF position breaking contact with the first fixed contact. An operating member is supported for movement in opposite directions relative to the casing between a first position moving the moving contact into the ON position and a second position moving the moving contact into the OFF position. A locking member associated with the operating member automatically locks the operating member in each of its first and second positions. The locking member is releasable to unlock the operating member upon manual movement in a direction different from that of the operating member.

Preferably, the locking member is supported by the operating member for movement therewith.

Preferably, the locking member is movable between an outer position locking the operating member and an inner position unlocking the operating member.

More preferably, the locking member has a U-shaped structure encompassing the operating member on opposite sides thereof as a sliding fit.

More preferably, the operating member is pivotable about an axis between the first and the second positions.

Further more preferably, the locking member is movable along an axis that extends transversely of the axis about which the operating member is pivotable.

In a preferred embodiment, the operating member and the locking member have respective portions exposed for manual operation, the portion of the locking member being located in the portion of the operating member.

More preferably, the portion of the operating member has a central recess within which the portion of the locking member is located.

As one example, the portion of the locking member has a concave profile.

As another example, the portion of the locking member has a convex profile.

It is preferred that the portion of the locking member includes grip enhancing element.

The electrical switch may be a rocker switch.

BRIEF DESCRIPTION OF DRAWINGS

The invention will now be more particularly described, by way of example only, with reference to the accompanying drawings, in which:

FIGS. 3A to 3J are schematic side views similar to FIG. 1, showing the operation of the electrical switch sequentially.

DETAILED DESCRIPTION OF PREFERRED EMBODIMENTS

Figure 1:
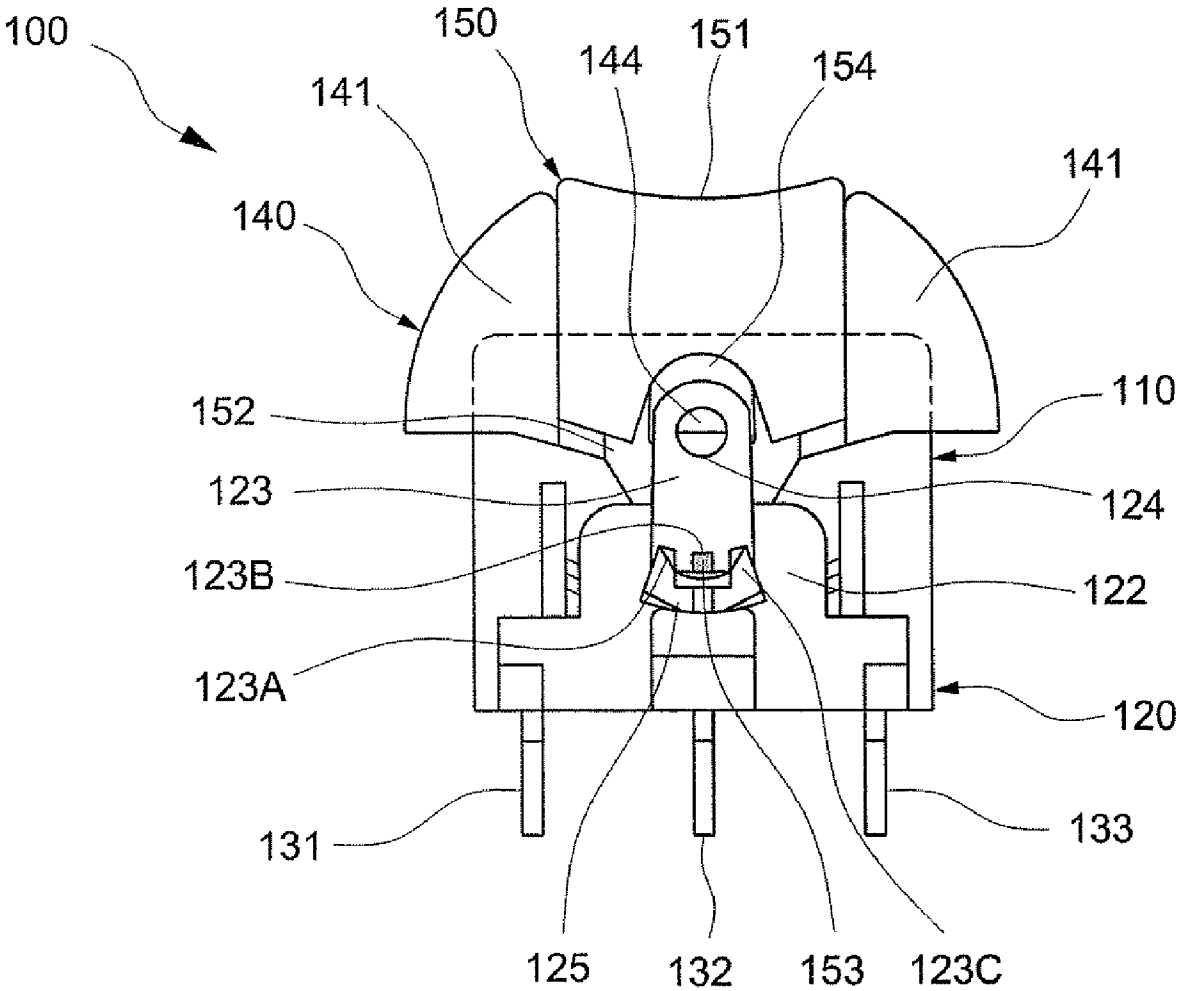
FIG. 1 is a schematic side view of an embodiment of an electrical switch in accordance with the invention, showing its internal construction.
Figure 2:
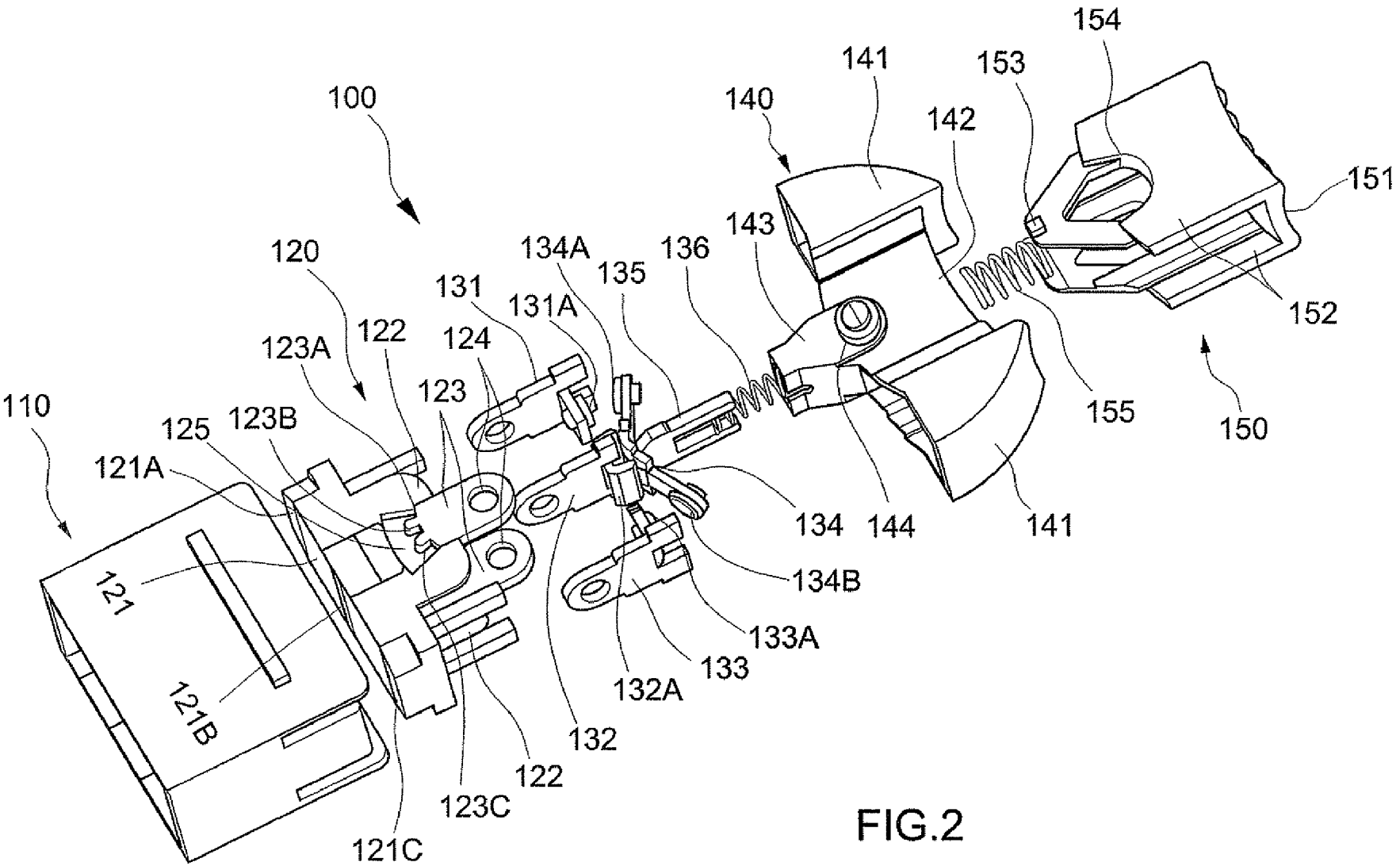
FIG. 2 is an exploded perspective view of the electrical switch of FIG. 1, showing all of its components.

Referring initially to FIGS. 1, 3 and 3A to 3J of the drawings, there is shown an electrical switch in the form of a rocker switch 100 embodying the invention, which comprises a casing 110 with a base 120, a series of three fixed contacts 131, 132 and 133, and a moving contact 134. The fixed contacts 131, 132 and 133 are generally flat oblong, and they extend vertically through respective slots 121A to 121C in a bottom wall 121 of the base 120 for support thereby, projecting outwardly from below the base 120 to act as switch terminals.

The moving contact 134 is a flat V-shaped contact lever 134 which is supported at its vertex upon an inner/upper end 132A of the middle fixed contact 132 (acting as a fulcrum) in the casing 110 for pivotal movement. The contact lever 134 includes contact pads 134A and 134B at its opposite ends for contacting respective inner end contact pads 131A and 133A of the first and third fixed contacts 131 and 133.

Figures 3A, 3B, 3C, 3D, 3E:
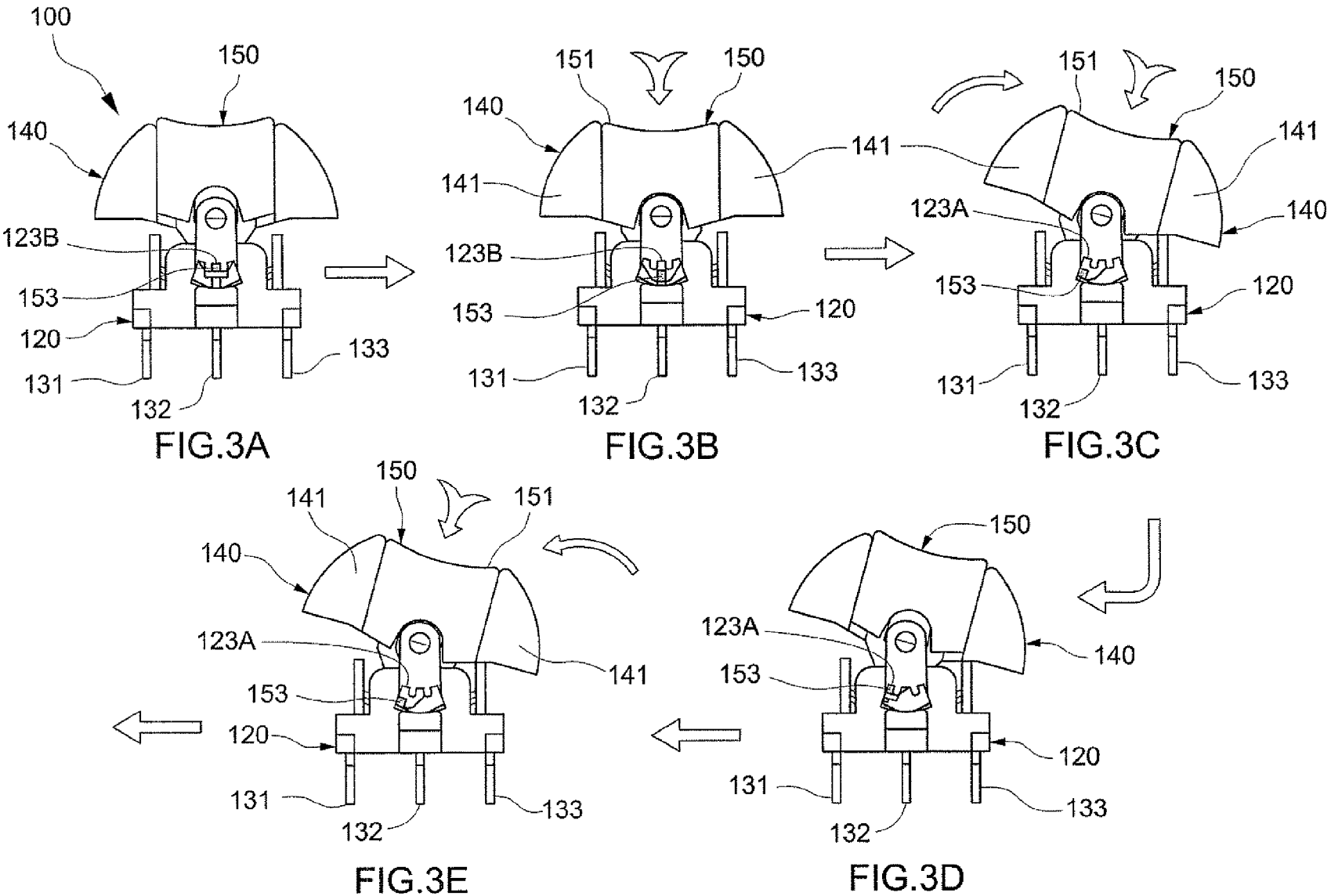

The contact lever 134 is pivotable between an ON position to the left making contact with the first and second fixed contacts 131 and 132 (FIG. 3D), or to the right making contact with the second and third fixed contacts 132 and 133 (FIG. 3I), and an OFF position centrally breaking contact with the first or third fixed contact 131 or 133 (FIG. 3A or 3F).

The base 120 has opposite left and right side walls 122. Each of these side walls 122 has a central finger 123 pointing upwards, which in turn has a first hole 124 through its outer end and a second aperture 125 through its inner end. The upper side of the aperture 125 is shaped to form a series of three downwardly facing notches 123A, 123B and 123C, at the inner finger end.

The electrical switch 100 includes an operating member or rocker 140 which has opposite end portions 141 and a recessed middle portion 142 between the two end portions 141. The middle portion 142 has a central stem 143 projecting downwards and a pair of aligned knobs 144 on opposite left and right sides thereof adjoining the stem 143. Through engagement of the side knobs 144 with the holes 124 of the fingers 123, the rocker 140 is supported by the base 120 as a rocker for pivotal movement about a horizontal pivotal axis through the knobs 144 and holes 124.

The rocker 140 is pivotable between a side position on either left or right side moving the moving contact 134 into the ON position (FIG. 3D or 31) and a central position moving the moving contact 134 into the OFF position (FIG. 3A or 3F).

The rocker 140 acts upon the moving contact 134 via a plunger 135 that protrudes out from within the stem 143. The plunger 135 is resiliently biased outwards by a coil spring 136 in the stem 143 to bear against the inner/upper surface of the contact lever 134. In operation, the plunger 135 is pivoted by the rocker 140 to slide across the apex of contact lever 134 to thereby flick the contact lever 134 to the opposite side about the fulcrum i.e. the middle fixed contact 132.

Engagement by either end contact pad 134A/134B of the contact lever 134 upon the respective fixed contact pad 131A/133A stops the rocker 140 in one of the two ON positions. The upper end of the middle fixed contact 132 has a U-shaped cross-section that provides a stable support for the contact lever 134 by its vertex in the central OFF position, under the action of the spring-loaded plunger 135.

The rocker 140 incorporates a locking member 150 for locking itself in each of its central and left and right side positions. The locking member 150 has an inverted U-shaped structure formed by a pair of opposite left and right side panels 152 and an upper end panel 151 interconnecting the side panels 152. Each of the side panels 152 has a V-shaped lower portion that includes a central aperture 154 and a small side protuberance 153 symmetrically below the aperture 154.

The locking member 150 piggyback rides on the rocker 140 for movement therewith, being fitted in and encompassing the middle portion 142 on opposite sides thereof as a sliding fit. By reason of their complementary shapes, the locking member 150 fully occupies the central recessed region on the rocker 140 between its end portions 141, being built-in or integrated therewith.

Each of the side panels 152 is disposed with its aperture 154 upon the knob 144 on the same side for engagement therewith. The apertures 154 are relatively larger to permit limited (vertical) sliding movement of the locking member 150 on the rocker 140 in a direction transversely of, and more precisely perpendicular to, the pivotal axis of the rocker 140. An internal coil spring 155 resiliently biases the locking member 150 outwards from the rocker 140.

In the assembled condition, the V-shaped lower portion of each of the side panels 152 extends right behind the corresponding side wall 122 of the base 120, with its side protuberance 153 reaching outwardly into the adjacent aperture 125 of the side wall 122 and engageable with one of the associated notches 123A to 123C depending upon the angular position of the rocker 140.

Under the upward resilient action of the spring 155, the locking member 150 and hence its side protuberance 153 on each side moves in and engages with one of the notches 123A to 123C to thereby lock the rocker 140 in the corresponding position and hence the switching condition of the rocker switch 100.

The switch 100 is locked OFF with the rocker 140 in the central position and the protuberances 153 engaging with the central notches 123B (FIG. 3A or 3F), and it is locked ON with the rocker 140 pivoted to either side and the protuberances 153 engaging with the relevant (opposite) side notches 123A or 123C (FIG. 3D or 3I).

The rocker 140 may conveniently be unlocked or released by depressing the locking member 150, whereupon the side protuberances 153 are pushed downwards and hence disengage from the notches 123A/123B/123C (FIG. 3B, 3C, 3E, 3G, 3H or 3J) to allow pivoting of the rocker 140 to another angular position (FIG. 3C, 3E, 3H or 3J) for as long as the locking member 150 remains depressed.

Upon release of the locking member 150, its side protuberances 153 automatically engage with the relevant (self-aligned) notches 123A/123B/123C to thereby fix the rocker 140 and hence lock the rocker switch 100 in the prevailing switching condition.

The locking member 150 is integrated with the rocker 140, thereby allowing one finger/thumb operation. The locking member 150 functions in a direction (i.e. upward/downward) different from that of the rocker 140 (i.e. left/right), and more precisely at right angles thereto, such that unlocking and switching actions are distinct actions to avoid mis-operation.

The upper end panel 151 of the locking member 150 is fully exposed, and it fits in and covers a large part of the exposed portion of the rocker 140 for manual operation by the finger/thumb of a user. The end panel 151 has a slightly concave profile and is formed with a series of knobs to enhance gripping. The arrangement is such that the locking member 150 can easily be reached and depressed to unlock the rocker 140. Upon depression, the locking member 150 sinks and leaves a shallow recess in the rocker 140 between its two end portions 141 (see FIG. 3C for example), which helps to retain the user's finger/thumb while operating the switch 100.

Figure 4:
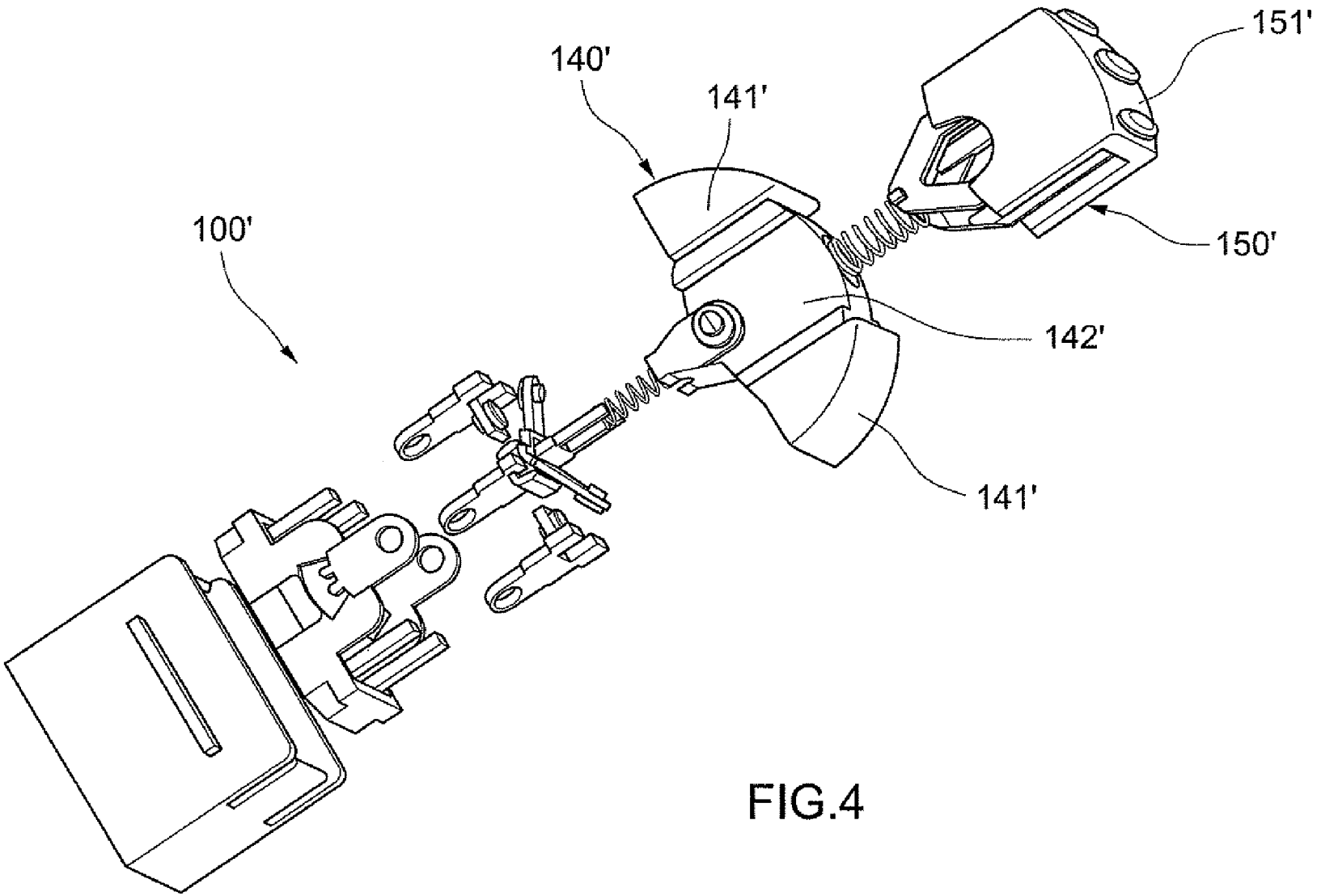
FIG. 4 is an exploded perspective view similar to FIG. 2, showing a slightly different embodiment of the electrical switch in accordance with the invention.

FIG. 4 shows a slightly different rocker switch 100' embodying the invention, with equivalent parts designated by the same reference numerals suffixed by an apostrophe sign. The only major difference lies in the shape of the rocker 140' and the locking member 150'. The locking member 150' has a slightly convex profile instead, which necessitates a corresponding change of shape to the upper surface of the middle portion 142' of the rocker 140'.

The invention has been given by way of example only, and various modifications of and/or alterations to the described embodiments may be made by persons skilled in the art without departing from the scope of the invention as specified in the appended claims.

The invention claimed is:

1. An electrical switch comprising:

a casing;

first and second fixed contacts;

first and second moving contacts supported in the casing, independently moving between respective first and the second ON positions, respectively making contact with the first fixed contact and second fixed contact, and an OFF position with no contact between either of the first and second moving contacts and either of the first and second fixed contacts;

an operating member supported for movement in opposite directions relative to the casing, between a first position moving the first moving contact into the first ON position, a second position moving the first and second moving contacts into the OFF position, and a third position moving the second moving contact into the second ON position; and a locking member, associated with the operating member, automatically locking the operating member in each of the first, second, and third positions, the locking member being releasable to unlock the operating member upon manual movement of the locking member in a direction different from directions of movement of the operating member between the first, second, and third positions.

2. The electrical switch as claimed in claim 1, wherein the locking member is supported by the operating member for movement with the operating member.

3. The electrical switch as claimed in claim 1, wherein the locking member is movable between an outer position farther from the first and second moving contacts, locking the operating member, and an inner position closer to the first and second moving contacts, unlocking the operating member.

4. The electrical switch as claimed in claim 3, wherein the operating member is pivotable about a first axis between the first, second, and third positions.

5. The electrical switch as claimed in claim 4, wherein the locking member has a U-shaped structure straddling, in a sliding fit, opposed lateral surfaces of the operating member, the lateral surfaces being transverse to the first axis.

6. The electrical switch as claimed in claim 4, wherein the locking member is movable along a second axis in locking and unlocking the operating member and the second axis is transverse to the first axis.

7. The electrical switch as claimed in claim 1, wherein the operating member and the locking member have respective portions exposed for manual operation, the portion of the locking member being located in the portion of the operating member.

8. The electrical switch as claimed in claim 7, wherein the portion of the operating member has a central recess within which the portion of the locking member is located.

9. The electrical switch as claimed in claim 8, wherein the portion of the locking member has a concave profile.

10. The electrical switch as claimed in claim 8, wherein the portion of the locking member has a convex profile.

11. The electrical switch as claimed in claim 8, wherein the portion of the locking member includes a grip-enhancing element.

12. The electrical switch as claimed in claim 8, wherein the portion of the locking member has a concave profile.

13. The electrical switch as claimed in claim 1, wherein the electrical switch is a rocker switch.

14. An electrical switch comprising:

a casing;

a base disposed within the casing;

a first fixed contact in the casing;

a first moving contact supported in the casing and moving between a first ON position, making contact with the first fixed contact, and an OFF position with no contact between the first moving contact and the first fixed contact;

an axle within casing;

an operating member pivotally mounted on the axle for pivoting in opposite directions relative to the casing, between a first position moving the first moving contact into the ON position and a second position moving the moving contact into the OFF position, wherein the base includes a finger having a periphery including at least two notches facing away from and radially arranged with respect to the axle;

a locking member associated with and slideably engaging the operating member for automatically locking the operating member in each of the first and second positions, the locking member being releasable to unlock the operating member upon movement of the locking member in a radial direction with respect to the axle, wherein the locking member includes a body straddling and slideably engaging lateral surfaces of the operating member, on an opposite side of the axle from the base, and an extension extending into the base and including a protrusion for selectively engaging each of the notches, for locking the operating member in each of the first and second positions; and a spring biasing the body of the locking member outwardly from axle and the base wherein movement of locking member against the bias of the spring, toward the base, displaces the protrusion from one of the notches and unlocks the operating member, and release of the locking member so that the protrusion engages one of the notches locks the operating member.

15. The electrical switch as claimed in claim 14, wherein the operating member and the locking member have respective portions exposed for manual operation, the portion of the locking member being located in the portion of the operating member.

16. The electrical switch as claimed in claim 15, wherein the portion of the operating member has a central recess within which the portion of the locking member is located.

17. The electrical switch as claimed in claim 16, wherein the portion of the locking member has a convex profile.

18. The electrical switch as claimed in claim 16, wherein the portion of the locking member includes a grip-enhancing element.

19. The electrical switch as claimed in claim 14, wherein the electrical switch is a rocker switch.

20. The electrical switch as claimed in claim 14 including a second fixed contact and a second moving contact in the casing, wherein the second moving contact is supported in the casing for movement between a second ON position, making contact with the second fixed contact, and the OFF position, with no contact between the second moving contact and either of the first and second fixed contacts, the operating member is supported for pivoting between the first and second positions and a third position moving the second moving contact into the second ON position, and the finger includes three of the notches and the locking member automatically locks the operating member in each of the first, second, and third positions.

* * * * *